US009013529B2

(12) United States Patent
Matsuda

(10) Patent No.: US 9,013,529 B2
(45) Date of Patent: Apr. 21, 2015

(54) THERMAL PRINTER AND METHOD FOR DETECTING THE WINDING DIRECTION OF THE INK RIBBON

(71) Applicant: Toshiba TEC Kabushiki Kaisha, Tokyo (JP)

(72) Inventor: Okiharu Matsuda, Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 204 days.

(21) Appl. No.: 13/853,587

(22) Filed: Mar. 29, 2013

(65) Prior Publication Data

US 2013/0286140 A1 Oct. 31, 2013

(30) Foreign Application Priority Data

Mar. 29, 2012 (JP) ..... 2012-076661

(51) Int. Cl.

| | |
|---|---|
| ***B41J 33/40*** | (2006.01) |
| ***B41J 33/51*** | (2006.01) |
| ***B41J 17/00*** | (2006.01) |
| ***B41J 17/02*** | (2006.01) |
| ***B41J 2/325*** | (2006.01) |

(52) U.S. Cl.
CPC . *B41J 2/325* (2013.01); *B41J 17/02* (2013.01)

(58) Field of Classification Search
USPC ..... 347/215, 217; 400/223, 244, 234, 218
See application file for complete search history.

(56) References Cited

U.S. PATENT DOCUMENTS

| | | | | |
|---|---|---|---|---|
| 6,082,914 | A * | 7/2000 | Barrus et al. | 400/234 |
| 8,730,287 | B2 * | 5/2014 | Bouverie et al. | 347/217 |

FOREIGN PATENT DOCUMENTS

| | | |
|---|---|---|
| JP | 2001-232880 | 8/2001 |
| JP | 2001-232881 | 8/2001 |
| JP | 2002-254782 | 9/2002 |
| JP | 2008-018553 | 1/2008 |
| JP | 4745903 | 5/2011 |

* cited by examiner

*Primary Examiner* — Huan Tran
(74) *Attorney, Agent, or Firm* — Patterson & Sheridan, LLP

(57) ABSTRACT

According to one embodiment, the present disclosure provides a thermal printer having a feeding motor that rotates the feeding shaft forward/backward depending on the winding configuration of the ink ribbon attached to the printer, an input part allowing the winding direction of the ink ribbon to be designated, a thermal head for transferring ink from the ribbon to a print medium, a wind-up motor that rotates the wind-up shaft of the ink ribbon after printing, a storage part for storing target rotating quantities for the wind-up motor and other target rotating quantities for the feeding motor in each winding direction, and a control part that extracts a target rotating quantity for the direction of tension for an ink-surface-outward winding ink ribbon or an ink-surface-inward winding ink ribbon and controls each motor.

20 Claims, 9 Drawing Sheets

ENLARGED VIEW IN DIRECTION OF A

*Fig. 8A*

| PRINTING SPEED (IPS) | RIBBON DIAMETER 1 | RIBBON DIAMETER 2 | RIBBON DIAMETER 3 | RIBBON DIAMETER 4 |
|---|---|---|---|---|
| SPEED 1 | SPEED PROFILE 011 | SPEED PROFILE 021 | SPEED PROFILE 031 | SPEED PROFILE 041 |
| SPEED 2 | SPEED PROFILE 012 | SPEED PROFILE 022 | SPEED PROFILE 032 | SPEED PROFILE 042 |
| SPEED 3 | SPEED PROFILE 013 | SPEED PROFILE 023 | SPEED PROFILE 033 | SPEED PROFILE 043 |
| SPEED 4 | SPEED PROFILE 014 | SPEED PROFILE 024 | SPEED PROFILE 034 | SPEED PROFILE 044 |
| SPEED 5 | SPEED PROFILE 015 | SPEED PROFILE 025 | SPEED PROFILE 035 | SPEED PROFILE 045 |

*Fig. 8B*

| PRINTING SPEED (IPS) | RIBBON DIAMETER 5 | RIBBON DIAMETER 6 | RIBBON DIAMETER 7 |
|---|---|---|---|
| SPEED 1 | SPEED PROFILE 051 | SPEED PROFILE 061 | SPEED PROFILE 071 |
| SPEED 2 | SPEED PROFILE 052 | SPEED PROFILE 062 | SPEED PROFILE 072 |
| SPEED 3 | SPEED PROFILE 053 | SPEED PROFILE 063 | SPEED PROFILE 073 |
| SPEED 4 | SPEED PROFILE 054 | SPEED PROFILE 064 | SPEED PROFILE 074 |
| SPEED 5 | SPEED PROFILE 055 | SPEED PROFILE 065 | SPEED PROFILE 075 |

*Fig. 9A*

SPEED PROFILE

| STATE (DIRECTION) | CURRENT VALUE (mA) | TIME (msec) |
|---|---|---|
| FORWARD ROTATING DIRECTION | 22 | 46 |
| FORWARD ROTATING DIRECTION | 22 | 14 |
| FORWARD ROTATING DIRECTION | 22 | 91 |
| FORWARD ROTATING DIRECTION | 22 | |
| FORWARD ROTATING DIRECTION | 93 | 8 |
| FORWARD ROTATING DIRECTION | 45 | 25 |
| FORWARD ROTATING DIRECTION | 29 | 53 |
| FORWARD ROTATING DIRECTION | 28 | 5 |
| FORWARD ROTATING DIRECTION | 24 | 5 |
| FORWARD ROTATING DIRECTION | 20 | 5 |
| FORWARD ROTATING DIRECTION | 14 | 5 |
| STOP | 0 | 0 |

*Fig. 9B*

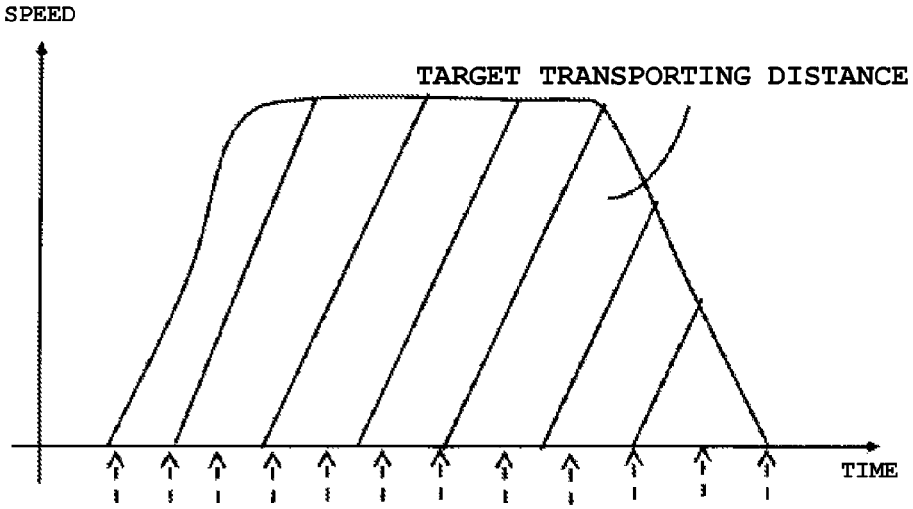

*Fig. 10A*

| PRINTING SPEED (IPS) | RIBBON DIAMETER 1 | RIBBON DIAMETER 2 | RIBBON DIAMETER 3 | RIBBON DIAMETER 4 |
|---|---|---|---|---|
| SPEED 1 | SPEED PROFILE 111 | SPEED PROFILE 121 | SPEED PROFILE 131 | SPEED PROFILE 141 |
| SPEED 2 | SPEED PROFILE 112 | SPEED PROFILE 122 | SPEED PROFILE 132 | SPEED PROFILE 142 |
| SPEED 3 | SPEED PROFILE 113 | SPEED PROFILE 123 | SPEED PROFILE 133 | SPEED PROFILE 143 |
| SPEED 4 | SPEED PROFILE 114 | SPEED PROFILE 124 | SPEED PROFILE 134 | SPEED PROFILE 144 |
| SPEED 5 | SPEED PROFILE 115 | SPEED PROFILE 125 | SPEED PROFILE 135 | SPEED PROFILE 145 |

*Fig. 10B*

| PRINTING SPEED (IPS) | RIBBON DIAMETER 5 | RIBBON DIAMETER 6 | RIBBON DIAMETER 7 |
|---|---|---|---|
| SPEED 1 | SPEED PROFILE 151 | SPEED PROFILE 161 | SPEED PROFILE 171 |
| SPEED 2 | SPEED PROFILE 152 | SPEED PROFILE 162 | SPEED PROFILE 172 |
| SPEED 3 | SPEED PROFILE 153 | SPEED PROFILE 163 | SPEED PROFILE 173 |
| SPEED 4 | SPEED PROFILE 154 | SPEED PROFILE 164 | SPEED PROFILE 174 |
| SPEED 5 | SPEED PROFILE 155 | SPEED PROFILE 165 | SPEED PROFILE 175 |

THERMAL PRINTER AND METHOD FOR DETECTING THE WINDING DIRECTION OF THE INK RIBBON

CROSS-REFERENCE TO RELATED APPLICATION

This application is based upon and claims the benefit of priority from Japanese Patent Application No. 2012-076661, filed Mar. 29, 2012; the entire contents of which are incorporated herein by reference.

FIELD

Embodiments described herein relate that the present disclosure provides a thermal printer and a method for detecting the winding direction of the ink ribbon.

BACKGROUND

In a thermal printer device that carries out printing by means of an ink ribbon, a thermal printing head is pressed on the ink ribbon. The ink ribbon, in turn, contacts a paper sheet, and a portion of the ink from the ink ribbon is transferred onto the paper sheet in the presence of heat generated by the thermal printing head. The ink ribbon utilized in the thermal printer device has an ink surface on one side of a film. As the ink surface is only present on one side of the film, there are two possible winding directions when installed in the thermal printer device, namely, an ink-surface-outward (outer ink surface) winding direction with the ink surface on the outer side of the winding, and an ink-surface-inward (inner ink surface) winding direction with the ink surface on the inner side of the winding.

The winding direction of the ink ribbons used with conventional thermal printer devices varies between different models of thermal printer devices. Therefore, ink ribbons of both winding direction types are available. However, a conventional thermal printer device only accepts ink ribbons with a single winding direction. Consequently, the ink ribbon used in the conventional thermal printer device is limited to only one type of ink ribbon of either the ink-surface-outward winding direction type or ink-surface-inward winding direction type. While both types of ink ribbon are available, the inability of a conventional thermal printer device to utilize both types of ink ribbon limits the usefulness of such devices.

DESCRIPTION OF THE DRAWINGS

FIGS. 8A and 8B illustrate a subset of table data for the forward rotation application direction adopted in the thermal printer related to an embodiment of the present disclosure.

FIG. 9A illustrates example data for the target rotating quantity in the thermal printer related to an embodiment of the present disclosure.

FIG. 9B is a diagram illustrating the target transporting distance of the ink-surface-outward winding ink ribbon in the same thermal printer.

FIG. 10A and FIG. 10B illustrate a subset of the table data in the application of the backward rotation direction adopted in the thermal printer in an embodiment of the present disclosure.

DETAILED DESCRIPTION

Figure 1:
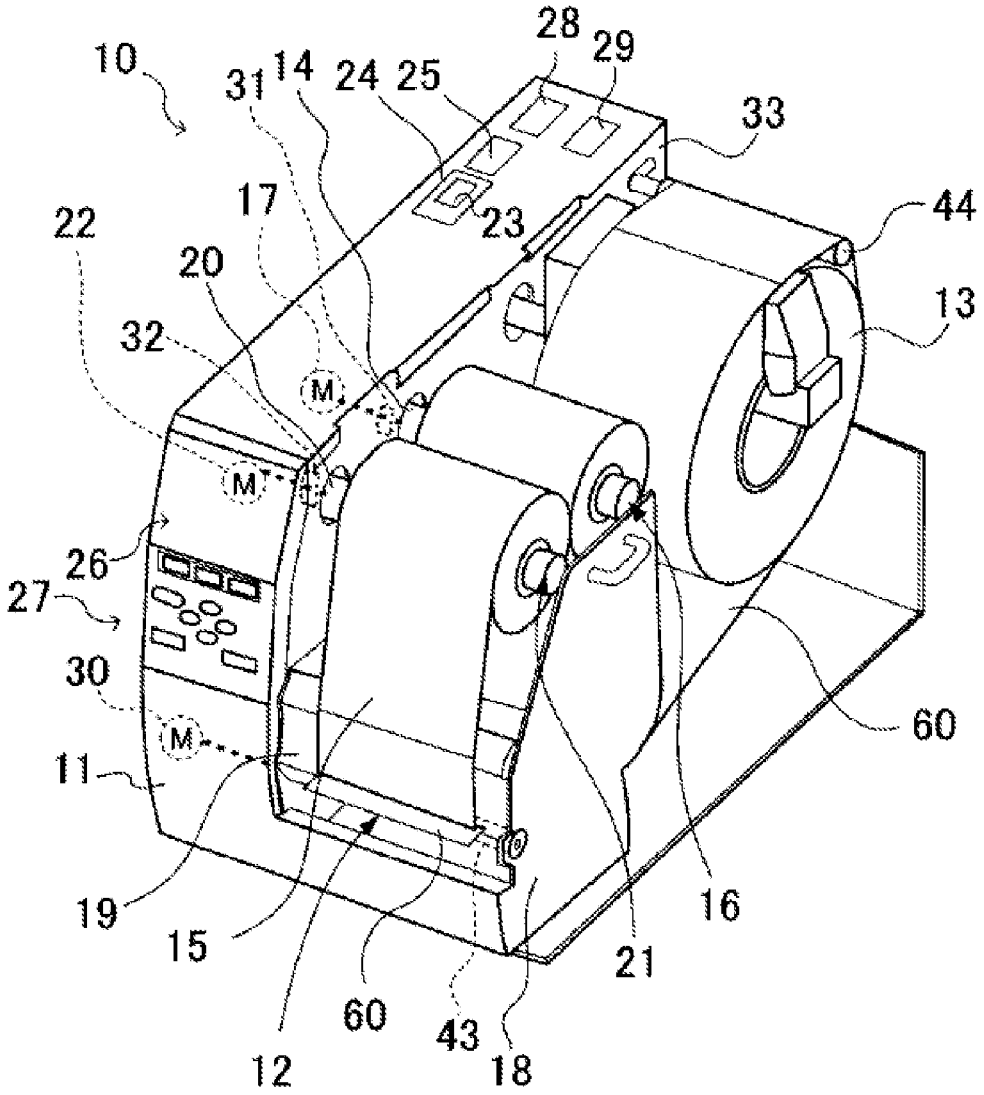
FIG. 1 is an oblique view illustrating the thermal printer related to an embodiment of the present disclosure.

In general, according to one embodiment, in the following, the thermal printer and the method for detecting the winding direction of the ink ribbon related to embodiments of the present disclosure is given with reference to FIG. 1 through FIG. 10B. The same reference numerals are adopted throughout the various figures, and when components or structures are used repeatedly, they will not be explained repeatedly.

In order to solve the aforementioned problems, the present disclosure provides, as an embodiment, a thermal printer having a feeding motor configured to rotate a feeding shaft forward or backward, depending on whether the ink ribbon being used for printing has an ink-surface-outward winding or an ink-surface-inward winding; an input part configured to accept winding direction information indicating whether an ink-surface-outward winding ink ribbon or an ink-surface-inward winding ink ribbon is installed/disposed on the feeding shaft rotated by the feeding motor; a thermal head configured to thermally transfer onto a medium the ink of the ink ribbon, which is released/unwound as the feeding shaft is rotated according to the winding direction information sent to the input part; a wind-up motor configured to rotate the wind-up shaft of the ink ribbon after printing by the thermal head; a storage part configured to store table data containing the target rotating quantity for the DC (direct current) driving current applied on the wind-up motor and the other target rotating quantities for the driving current applied as DC on the feeding motor in each direction; and a control part configured to extract each target rotating quantity in the direction in which the tension is applied, depending on the winding direction information stored in storage part, and to control the wind-up motor and the feeding motor.

As another embodiment, the present disclosure provides a method for detecting the winding direction of ink ribbon in a thermal printer, whereby the torque in one direction is generated in the feeding motor that rotates the feeding shaft of an ink ribbon with ink-surface-outward winding or ink-surface-inward winding, and a torque in the forward direction is generated in the wind-up motor that rotates the wind-up shaft of the ink ribbon; the rotation velocity and rotating direction of the feeding shaft are detected; according to the results of detection, determination is made as to whether the ink ribbon has the ink-surface-outward winding or the ink-surface-inward winding configuration using the magnitude of the tension in the opposite direction of the wind-up direction of the ink ribbon.

FIG. 1 is an oblique view illustrating the thermal printer in an embodiment of the present disclosure. It shows the state when the cover case has been removed. Here, the thermal printer 10 is a thermal transfer type printer that can handle both an ink-surface-outward winding ink ribbon and an ink-surface-inward winding ink ribbon. This thermal printer 10 has the following parts: a case 11, a paper exhausting port 12 opened on the front surface of the case 11 from which printed output may exit the printer, a paper roll 13 that has paper 60 (print medium) wound up on it, a feeding core 16 (feeding shaft) with an ink-surface-outward winding ink ribbon 15 set on a shaft 14 (wind-up shaft) (in the example shown), and a feeding motor 17 that rotates the feeding core 16 forward or backward.

Here, in this example, the ink-surface-outward winding ink ribbon 15 refers to a ribbon made of a base film having an ink surface applied on one side of it with the ribbon wound up such that the inked ribbon surface faces towards the outside of the wound ribbon (that is, radially away from feeding core 16). The feeding core 16 may also allow an ink-surface-inward winding ink ribbon to be set on it. An ink-surface-inward winding ink ribbon has the inked surface on the other side (or back side) of the base film as it is wound up into a roll and will be explained later.

Figure 2:
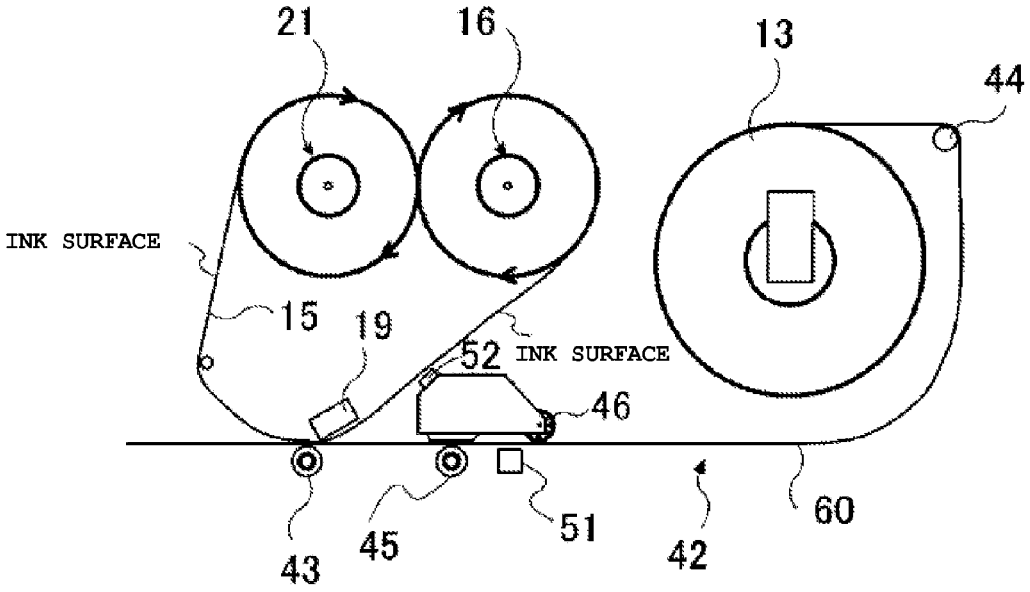
FIG. 2 is a diagram illustrating an example of the ribbon transporting route of the ink-surface-outward winding ink ribbon adopted in the thermal printer related to an embodiment of the present disclosure.

FIG. 2 is a diagram illustrating an example of the ribbon transporting route when the ink-surface-outward winding ink ribbon 15 is engaged between the feeding core 16 and the wind-up core 21.

Figure 3:
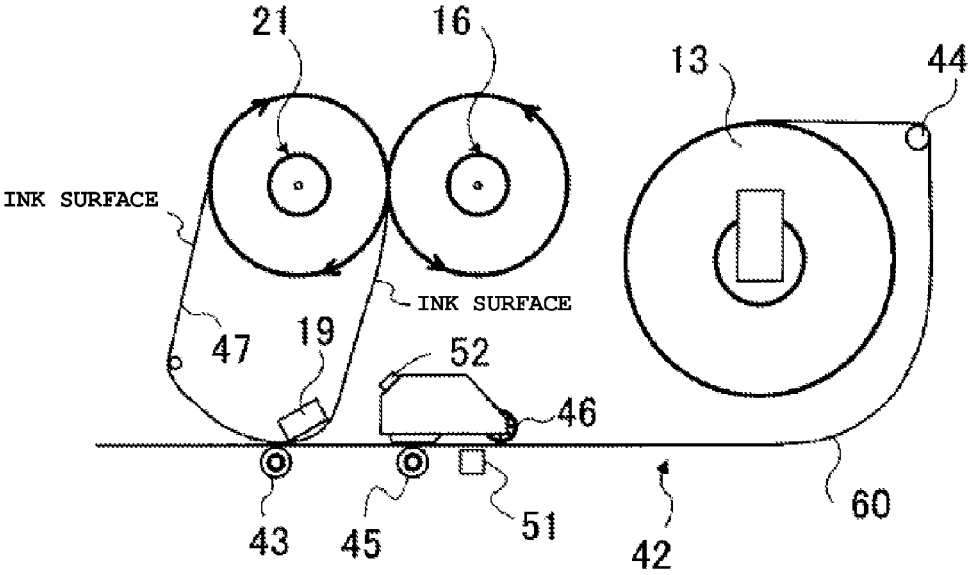
FIG. 3 is a diagram illustrating an example of the ribbon transporting route of the ink-surface-inward winding ink ribbon adopted in the thermal printer related to an embodiment of the present disclosure.

FIG. 3 is a diagram illustrating an example of the ribbon transporting route of an ink-surface-inward winding ink ribbon 47 when the ink-surface-inward winding ink ribbon 47 is engaged between the feeding core 16 and the wind-up core 21.

As depicted in FIG. 2 and FIG. 3, either of the ink-surface-outward winding ink ribbon 15 or ink-surface-inward winding ink ribbon 47 can be installed on the feeding core 16.

As used here, "forward rotation" refers to rotation in the clockwise direction when an end surface of the shaft 14 is viewed from the plate 18. "Backward rotation" refers to a counter-clockwise rotation when an end surface of the shaft 14 is viewed from the plate 18. As forward rotation is carried out, the ink-surface-outward winding ink ribbon 15 is transported from the feeding core 16 to the wind-up core 21. As backward rotation is carried out, the ink-surface-inward winding ink ribbon 47 is also transported from the feeding core 16 to the wind-up core 21.

The thermal printer 10 shown in FIG. 1 has the following parts: a key input part 27 (input part) for the user to perform input operations for the winding direction information of the ink-surface-outward winding ink ribbon 15 or the ink-surface-inward winding ink ribbon 47 on the outer peripheral surface of the feeding core 16 rotated by the feeding motor 17; a thermal head 19 that causes the thermal transfer of the ink to the paper 60, with the ink from the ink-surface-outward winding ink ribbon 15 or the ink-surface-inward winding ink ribbon 47 released by the forward rotation of the feeding core 16 corresponding to the winding direction information input by the key input part 27; a wind-up core 21 (wind-up shaft) that has the ink-surface-outward winding ink ribbon 15 or the ink-surface-inward winding ink ribbon 47, after printing the output, wound up on the shaft 20 with the ink surface on the outer side; and a wind-up motor 22 that rotates the wind-up core 21 to wind up the ink-surface-outward winding ink ribbon 15 or the ink-surface-inward winding ink ribbon 47 on the wind-up core 21.

In addition, it has a ROM (read-only memory) 24 (storage part) that stores the speed profile table 23 (table data) which contains, for each direction of the target rotation, a quantity including the current value of the DC driving current applied on the wind-up motor 22 and its timestamp (indicating the time at which the current is applied), and another target rotation quantity including the current value of the DC driving current applied on the feeding motor and its timestamp; and controller 25 that receives the application direction (ink-surface winding direction), current values and times from the speed profile table 23, and drives the wind-up motor 22 and the feeding motor 17.

In addition, the thermal printer 10 has the following parts: a display unit 26 arranged for example, as depicted in FIG. 1, on the left hand side towards the front surface of the case 11, a RAM (random access memory) 28 that stores the winding direction information set by the key input part 27, and a main controller 29 (controller), which extracts from the RAM 28 the target rotation quantity of the feeding motor 17 that applies a tension on the ink-surface-outward winding ink ribbon 15 or ink-surface-inward winding ink ribbon 47 and the target rotation quantity of the wind-up motor 22, with these quantities indicating the winding direction information, and which controls to drive the feeding motor 17 and the wind-up motor 22.

A cover case may be attached via hinges, or the like, on the case 11 to allow the case to be opened or closed as needed. The paper exhausting port 12 is located at the end in the transporting direction of the paper 60. The paper roll 13 can be exhausted out as the platen roller 43 rotates. The platen roller 43 is driven to rotate by the paper transporting motor 30. Here, the paper transporting motor 30 is a stepping motor. The feeding core 16 releases the ribbon from the rear side. The feeding motor 17 is a rear-side ribbon motor with its rotating direction controlled by the DC driving current. A DC motor is adopted as the feeding motor 17. The feeding motor 17 may directly drive the shaft 14. The motor rotating direction of the feeding motor 17 is the same as the rotating direction of the feeding core 16. A slit sensor 31 (a detecting part) is attached on the shaft 14. The slit sensor 31 outputs a pulse signal corresponding to a circumferential velocity depending on the diameter of the slit disk 35 (FIG. 4).

Figure 4A:
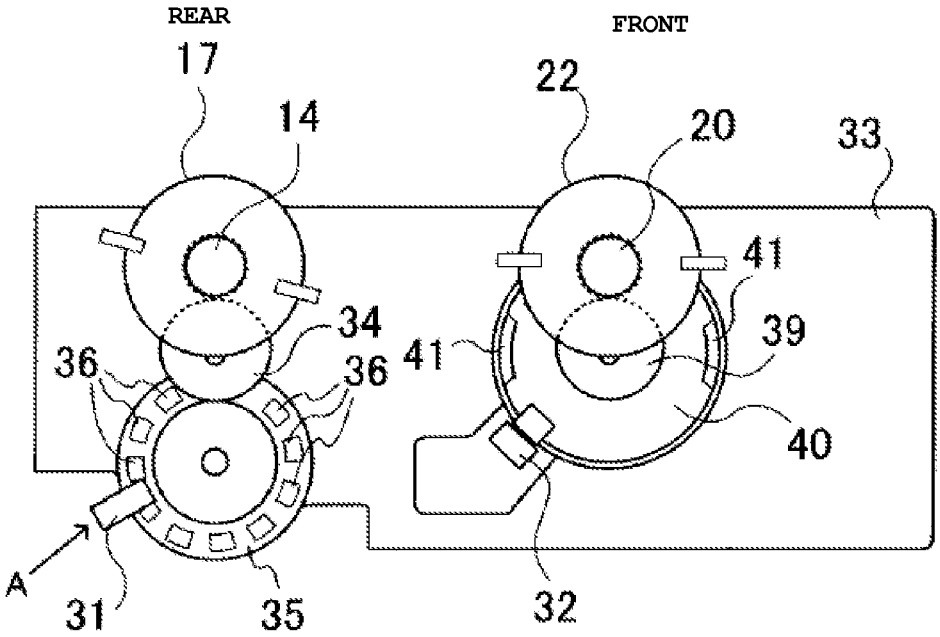
FIGS. 4A and 4B are diagrams illustrating an example of the components of the detecting part of a thermal printer related to an embodiment of the present disclosure.

FIG. 4A is a diagram illustrating an example of the position where the slit sensor 31 is located. The figure shows the internal structure as viewed from the left hand side surface to the right hand side surface of the case 11. The left/right sides shown in the figure correspond to the rear side and front side, respectively. The same keys as those in the above are adopted here. On the front side, another slit sensor 32 attached on the shaft 20 is arranged. The slit sensor 31 on the rear side and the slit sensor 32 on the front side have different numbers of slit holes.

Figure 4B:
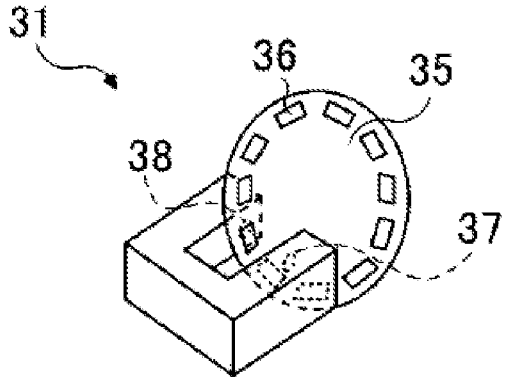

On the rear side, the slit sensor 31 is located below the shaft 14. The slit disk 35 is connected via the gear unit 34 to the end portion of the shaft 14. This slit disk 35 has multiple slit holes 36 arranged along the circumferential direction of its outer peripheral portion. FIG. 4B is an enlarged oblique view illustrating the main portion of the slit sensor 31 (see A in the figure). The same keys as those in the above are adopted here. For example, the slit sensor 31 has two U-shaped arms. An LED or other light emitting element 37 is arranged on the tip of one of the arms. A photodiode or other light receiving element 38 is arranged on the tip of the other arm. The light emitted from the light emitting element 37 transmits through the slit holes 36, and the transmitted light is received by the light receiving element 38. Or, the light may be blocked by the disk surface between two adjacent slit holes 36.

The slit sensor 31 has a function whereby the received/blocked light of light receiving element 38 are encoded to high/low pulse signals, respectively. The high/low signal is sent from the slit sensor 31 to the main controller 29. The various slit holes 36 have the same width between adjacent slit holes 36 along the circumferential direction. In addition, the slit sensor 32 on the front side is located below the shaft 20. The slit disk 40 connected with the shaft 20 via the gear unit 39 has, two slit holes 41 arranged symmetric to each other on the disk side surfaces with the rotating center between them. The other features of the constitution of the slit sensor 32, except the number of the slits, are substantially the same as the constitution of the slit sensor 31. These slit sensors 31, 32 are separated by a wall 33 from the paper roll 13, the feeding core 16 and the wind-up core 21.

Now, returning to FIG. 1, the key input part 27 may have various types of keys and buttons. The key input part 27 allows the user to set the winding direction information in the RAM 28 indicating whether the ribbon in the printer is ink-surface-outward winding or ink-surface-inward winding.

As shown in FIGS. 2 and 3, the thermal head 19 is arranged above the platen roller 43 set halfway up the paper transporting route 42. This thermal head 19 is energized so that it is in contact with the platen roller 43 from the upper side pressing downward. The thermal head 19 may have plural heat generating elements.

As the thermal head 19 is pressed on the outer peripheral surface of the platen roller 43, and the heat generating elements generate heat, the heat melts or sublimates the ink, so that the ink is transferred from the ink surface of the ribbon onto the paper 60.

For the thermal printer 10, a damper 44 may be set on the upstream side of the paper transporting route 42, so that it dampens the impact force applied at the instant when the paper 60 is stretched. The thermal printer 10 has rollers 45, 46 for guiding and pinching paper arranged on the downstream side of the paper transporting route 42.

As shown in FIG. 2, the wind-up core 21 has the ink-surface-outward winding ink ribbon 15 wound up on it so that the ink surface of the ink-surface-outward winding ink ribbon 15 remains on the outward side when wound on to wind-up core 21.

As for the ink-surface-inward winding ink ribbon 47, as shown in FIG. 3, the wind-up core 21 winds up the ink-surface-inward winding ink ribbon 47 with the ink surface of ink ribbon 47 is on the outward side when wound on to wind-up core 21.

The wind-up motor 22 is a front-side ribbon motor with its rotating direction controlled by the direction of the DC driving current. A DC motor is adopted as the wind-up motor 22. The wind-up motor 22 directly drives the shaft 20. The motor rotating direction of the wind-up motor 22 and the core rotating direction of the wind-up core 21 are in the same direction. Together with the feeding motor 17, the wind-up motor 22 applies a tension on the ink-surface-outward winding ink ribbon 15 or the ink-surface-inward winding ink ribbon 47. Here, the tension refers to the tension for wind-up or the back tension as the motor on the feeding side (feeding motor 17) rotates in the backward direction. For example, as the wind-up motor 22 and the feeding motor 17 are driven to rotate, the tension in the wind-up direction is made to be a little higher than the back tension in the backward direction.

The speed profile table 23 has multiple speed profiles each including the application direction, current value, and the driving time. The speed profile table 23 stores several speed profiles for the wind-up motor 22. The speed profile can be established for each set of the ribbon spool diameter and printing speed of the wind-up core 21. Here, the printing speed refers to the speed of printing by the thermal head 19 on the paper 60. Also, the speed profile table 23 stores multiple speed profiles for each set of the ribbon spool diameter and the printing speed of the feeding core 16.

Figure 5:
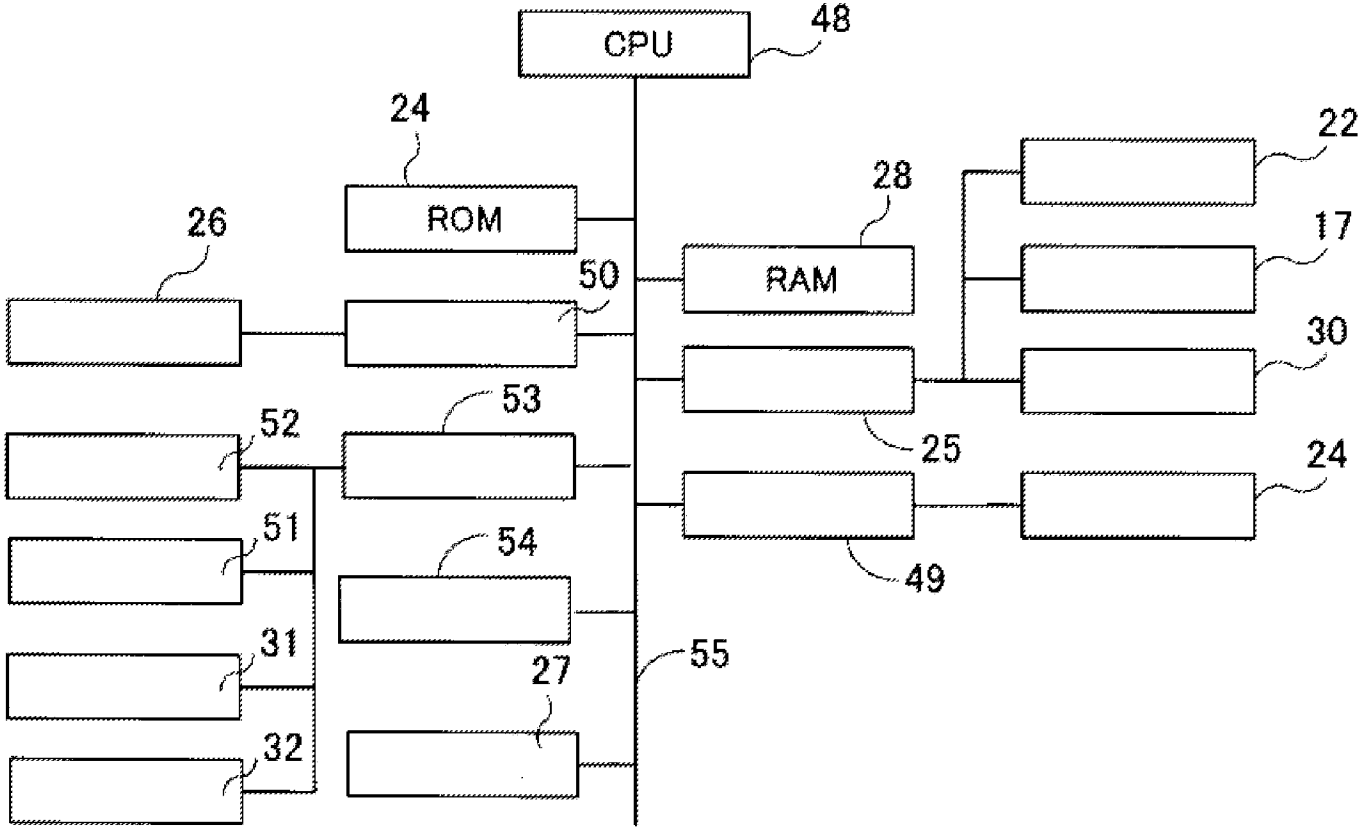
FIG. 5 is a block diagram illustrating the control system of the thermal printer related to an embodiment of the present disclosure.

FIG. 5 is a block diagram illustrating the control system showing mainly the elements of the electrical system of the thermal printer related to an embodiment of the present disclosure. The same keys as those in the above are adopted. Here, the motor controller 25 controls driving so that the ink-surface-outward winding ink ribbon 15 or the ink-surface-inward winding ink ribbon 47 is transported in the ribbon transporting direction while tension is applied on it. For example, the motor controller 25 controls so that a prescribed tension is applied on the ink-surface-outward winding ink ribbon 15 or the ink-surface-inward winding ink ribbon 47 independent of the remaining ink ribbon quantity on the feeding core 16 and the used ink ribbon quantity on the wind-up core 21. For example, an LSI (large scale integration) is adopted as the motor controller 25.

Also, thermal printer 10 has a CPU (central processing unit) 48, a nonvolatile ROM 24 and a volatile RAM 28, which together form the main controller 29. The ROM 24 has the rotating diameter of the slit disk 35, the number of the slit holes 36, and the distance between adjacent slit holes 36 stored in it beforehand. The ROM 24 also stores the rotating diameter of the slit disk 40, the distance in the circumferential direction between the adjacent slit holes 41, and the distance between the right hand side end of one of the slit holes 41 and the left hand side end of the other slit hole 41. The ROM 24 also stores the speed profile table 23, the firmware and the application programs. The RAM 28 is for use as the region of operation. The main controller 29 carries out the overall control.

The main controller 29 measures the rotation velocities of the slit disk 35 and slit disk 40 from the outputs of the slit sensors 31, 32, respectively. With the slit sensor 31, the main controller 29 measures the time needed for one of the slit holes 36 to pass through one optical axis. Also, the main controller 29 may count how many times the optical axis passes through the slit hole 36 within a prescribed time. With such measurement or counting, the main controller 29 can determine the circumferential velocity of the slit disk 35. Then, the main controller 29 multiplies the various types of constants from the ROM 24 for the circumferential velocity to determine the angular velocity of the shaft 14 of the feeding motor 17 and the angular velocity of the feeding core 16.

The main controller 29 can determine whether the feeding core 16 has a turned on/off rotation state, as well as the rotating direction. The main controller 29 may also determine the angular velocity of the wind-up motor 22 and the angular velocity of the wind-up core 21. After the user sets the ink-surface-outward winding ink ribbon 15 or the ink-surface-inward winding ink ribbon 47 on the thermal printer 10, the main controller 29 automatically detects, when reset, whether the ribbon set in the thermal printer is an ink-surface-outward winding type or an ink-surface-inward winding type.

The thermal printer 10 also has the following parts: a head controller 49 for controlling the position of the thermal head 19, a display controller 50 for controlling display of the display unit 26, a paper detecting sensor 51 for indicating a jam or searching for the head (beginning) of the paper 60, a ribbon end sensor 52 that detects a silver film body bonded at the ribbon end of the ink-surface-outward winding ink ribbon 15 or the ink-surface-inward winding ink ribbon 47, an I/O port 53 for various types of sensors, a communication interface part (communication I/F) 54 for receiving the printing data from, for example, a personal computer connected via a network, and a bus 55. Here, the ribbon end sensor 52 detects the reflected light when light is incident on the ribbon ink surface, and it then detects the reflected light from the silver film body.

According to the detecting method of the ink ribbon rotating direction related to the present embodiment of the invention, after the ink ribbon with an unknown winding direction is set by the user across the feeding core 16 and the wind-up core 21, the ink ribbon is stretched in forward/backward directions to generate a tension, and, from the magnitude of the tension, the method can automatically detect whether the ribbon is an ink-surface-outward winding or an ink-surface-inward winding.

According to this method, the main controller 29 controls to generate a load torque in the winding direction by the wind-up motor 22 and to generate a load torque in the direction opposite to the winding direction by the feeding motor 17. As a result, the rotating force on the wind-up side is higher than the rotating force on the feeding side, the ink ribbon under consideration is transported in the forward rotating direction. From the rotation velocity and rotating direction of the feeding core 16 detected from the output of the slit sensor 31, the main controller 29 determines the magnitude of the tension in the direction opposite to the wind-up direction of the ink ribbon under consideration. For example, as shown in FIG. 2 and FIG. 3, while the ink ribbon has a light tension, the feeding core 16 on the rear side is started in a clockwise rotation, so that the ink ribbon starts to tension (the tensile state) or to relax (the relaxed state) depending on the ribbon configuration on feeding core 16.

As the tensile state and the relaxed state have different magnitudes of tension, the main controller 29 can determine whether the ink ribbon under consideration on the feeding core 16 is an ink-surface-outward winding or an ink-surface-inward winding from the magnitude of the tension.

When the tensile state holds, the main controller 29 judges that the ribbon is of an ink-surface-inward winding type. On the other hand, when the ribbon is relaxed and in idle rotation, the main controller 29 checks that the ribbon is attached, and then determines that the ribbon is of an ink-surface-outward winding type. In this way, it is possible for the ribbon type to be automatically detected.

In the following, an example explanation is given for the case of manual operation rather than automatic detection of the ribbon type. Here, the main controller 29 displays on the display unit 26 a message prompting user input of the winding direction of either ink-surface-outward winding or ink-surface-inward winding. In response, the user manipulates the key input part 27 to set it, for example, to "ink-surface-outward winding." Then, with the operation of the user, the printing speed is read by the thermal printer 10. The thermal printer 10 receives the data to be printed from a personal computer, or the like, via a cable, or the like, not shown in the figure. The main controller 29 then acquires the speed profile for the various motors before carrying out the printing treatment.

The main controller 29 acquires the speed profile so that the ribbon transporting rate is kept constant, that is, independent of the remaining quantity of ribbon, corresponding to the printing speed. Both the feeding motor 17 and wind-up motor 22 are DC motors.

Figure 6A:
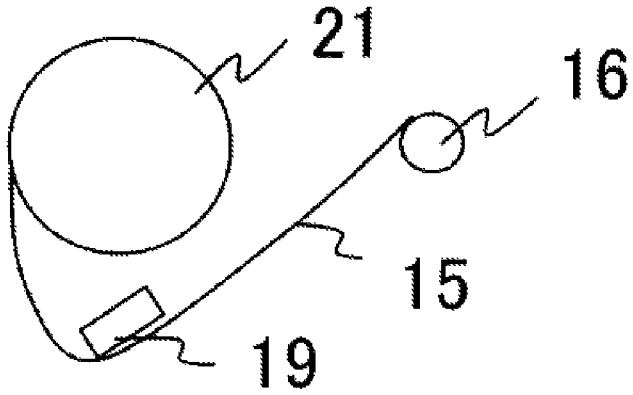
FIG. 6A, FIG. 6B and FIG. 6C are diagrams illustrating the ribbon diameters of the various ink-surface-outward winding ink ribbons and ink-surface-inward winding ink ribbons adopted in the thermal printer related to an embodiment of the present disclosure.
Figure 6B:
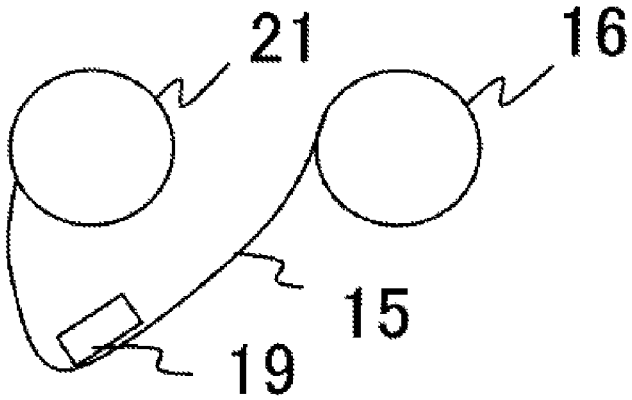
Figure 6C:
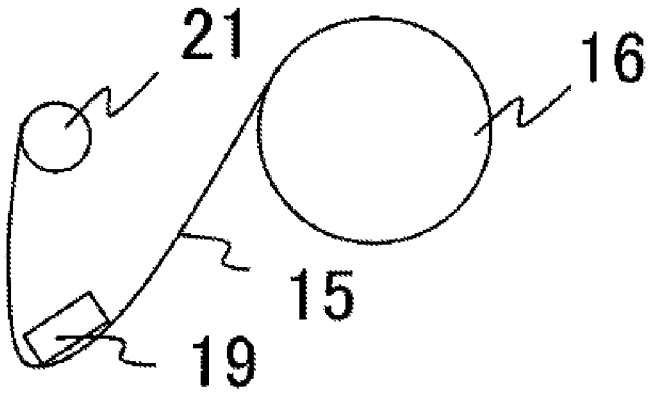

FIG. 6A through FIG. 6C are diagrams illustrating different magnitudes of these two ribbon diameters. FIG. 6A shows the ribbon diameters of the feeding core 16 and the wind-up core 21 as a small diameter and a large diameter, respectively. FIG. 6B shows the ribbon diameters as intermediate diameters. FIG. 6C shows the ribbon diameters as a large diameter and a small diameter, respectively. The main controller 29 guarantees that the feeding core 16 and wind-up core 21 are driven so that the ribbon transporting rate is constant in the various states (e.g., when the diameters are both of small diameter, intermediate diameter, or intermediate diameter, as well as when they are of large diameter and small diameter, respectively).

For the wind-up motor 22, it is necessary to generate an appropriate magnitude of the rotating driving force so that the ribbon is in slight tension. It is necessary to have the ribbon in this tensile state for running. The main controller 29 controls to ensure that tension is applied on the ribbon while the driving current value and driving time for the DC motors are adjusted so that the ribbon transporting speed is kept constant.

Figure 7:
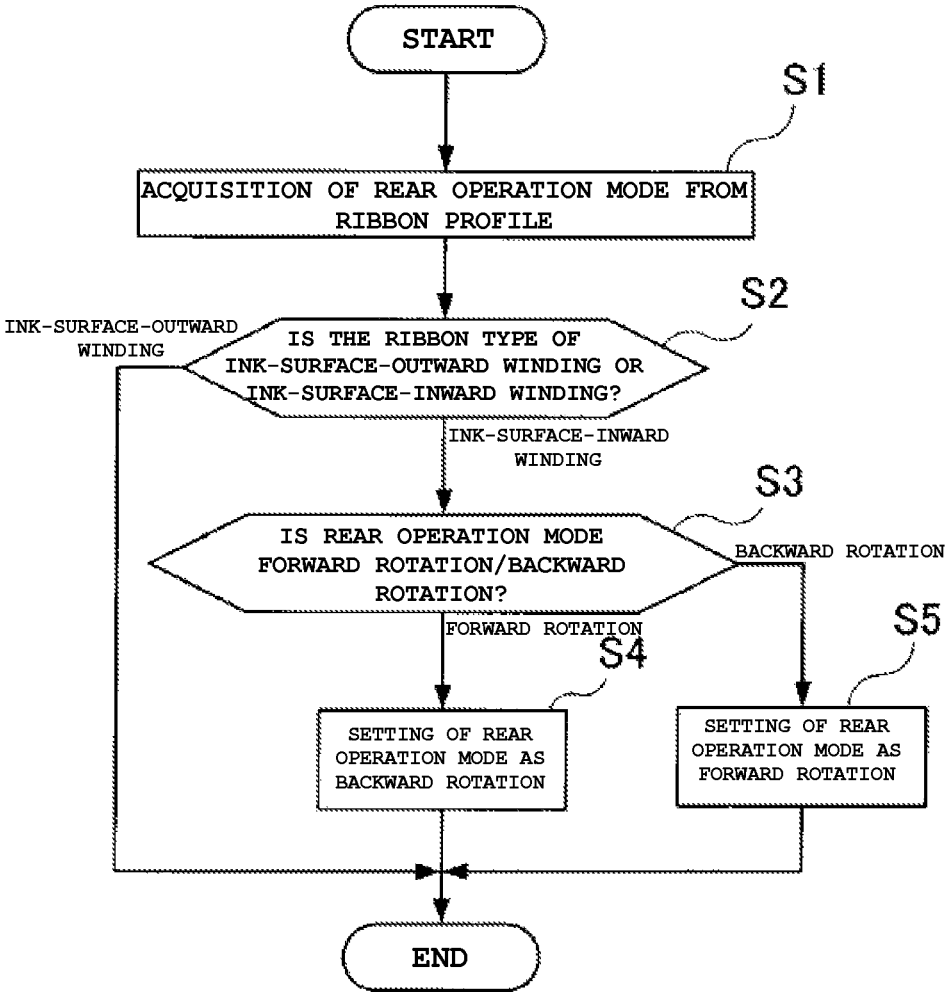
FIG. 7 is a flow chart illustrating an example of operation of the thermal printer related to an embodiment.

At first, main controller 29 acquires the speed profile of the rear-side feeding core 16. FIG. 7 is a flow chart illustrating an example of the operation of the thermal printer 10 related to an embodiment of the present disclosure. In step S1, the main controller 29 acquires the data for the rear-side operation mode (for control of feeding motor 17). From the entirety of the speed profile table 23, all of the speed profiles for the feeding core 16 are developed in a prescribed region of the RAM 28.

In step S2, the main controller 29 reads the preset winding direction information from the RAM 28. The fact that the winding direction is the ink-surface-outward winding direction is equivalent to driving by the ribbon transporting route in the example shown in FIG. 2. The main controller 29 controls rotation of the feeding core 16 to release the ink-surface-outward winding ink ribbon 15. In step S2, through the route denoted as the "ink-surface-outward winding," the main controller 29 sets the rear operation mode as the forward rotation.

In the following, an example in which the main controller 29 controls so as to have the feeding core 16 in forward rotation will be explained. Here, FIG. 8A and FIG. 8B illustrate an example of a portion of the table data of the speed profile table 23. Here, a plurality of ribbon profiles such as the speed profile 011 through 015 are accommodated for each printing speed and each ribbon diameter.

FIG. 9A shows the specific values of speed profile 011 for "ribbon diameter 1," "speed 1" as an example among the multiple speed profiles shown in FIG. 8A. The information about the time of driving and the current value for rotation in the forward direction is described sequentially in the time series. Here, the printing speed in units of ips (inches per second) represents the printing distance in inches over 1 second. "Speed 1," etc. are represented as 3 ips, 5 ips, 14 ips. "Ribbon diameter 1", etc. are represented as $\phi 30$, $\phi 40$, $\phi 50$, . . . .

FIG. 9B is a diagram illustrating the target transporting distance of the ink-surface-outward winding ink ribbon 15. The total area indicated by hatched portion in the figure corresponds to the target transporting distance of the ink-surface-outward winding ink ribbon 15.

Main controller 29 determines the ribbon diameter of the feeding core 16 from the output of the slit sensor 31. For example, the main controller 29 determines the number of revolutions of the slit disk 35 within a prescribed period and then determines the ribbon diameter from the number of revolutions. According to the ribbon diameter and the printing speed preset by the user, the main controller 29 writes the driving current value and the driving time in the RAM 28 from that shown in FIG. 9A. Just as in the example concerning the feeding core 16, the main controller 29 acquires the speed profile of forward rotation for the wind-up core 21 on the front side. During the printing, main controller 29 controls so that the feeding core 16 is rotated in the backward rotation direction, and the wind-up core 21 is rotated in the forward rotating direction, so that the ink-surface-outward winding ink ribbon 15 is fed while kept in a tensile state.

The main controller 29 controls to rotate the paper transporting motor 30 and rollers 45, 46, and carries out head searching for the paper 60 according to the output of the paper detecting sensor 51. The thermal head 19 and the platen roller 43 have the ink-surface-outward winding ink ribbon 15 and the paper 60 held between them. The thermal head 19 carries out printing. The printed paper 60 is exhausted through the paper exhausting port 12. The main controller 29 further controls to transport the ink-surface-outward winding ink ribbon 15. As the ribbon end is detected by the ribbon end sensor 52, the main controller 29 controls to stop the feeding motor 17, the wind-up motor 22 and the paper transporting motor 30. The main controller 29 controls to display a message indicating the need for ribbon exchange on the display unit 26.

In the following, an example of the ink-surface-inward winding will be explained. The user sets an ink-surface-inward winding ink ribbon 47 on the feeding core 16, and manipulates the key input part 27 to input the winding direction information of "ink-surface-inward winding". Then, the main controller 29 executes the treatment of step S1 and step S2 shown in FIG. 7. In step S2, it is judged that the route denoted as "ink-surface-inward winding" is appropriate. In step S3, it is determined whether the rear operation mode is a forward rotation or backward rotation is to be used. If the route denoted as "backward rotation" is selected as the condition in S3, the main controller 29 controls so that in step S5, the rear operation mode is set as the forward rotation. The direction of the speed profile to be acquired is inverted from the forward rotating direction to the backward rotation direction.

FIG. 10A and FIG. 10B are illustrate the multiple speed profiles available when the feeding core 16 of the speed profile table 23 is in the backward rotation direction. The main controller 29 determines the ribbon diameter of the feeding core 16, and it acquires the current value and time in the backward rotation direction based on the ribbon diameter and the printing speed. The main controller 29 then acquires the speed profile of forward rotation of the wind-up core 21. As a printing instruction is received, the thermal printer 10 carries out printing just as in the case of forward rotation.

In addition, once the thermal printer 10 is set for the ink-surface-inward winding, it may be necessary to ensure forward rotation of the feeding core 16 by adjusting the ribbon position and the tension, the main controller 29 controls to execute the treatment of steps S1, S2 and S3.

If in step S3, the route denoted as "forward rotation" is selected, and main controller 29 sets the rear operation mode as the backward rotation in step S4. When there is no need for the feeding core 16 to make forward rotation, the main controller 29 carries out the treatment of steps S1-S5. The thermal printer 10 can carry out printing corresponding to both the ink-surface-outward winding ink ribbon 15 and the ink-surface-inward winding ink ribbon 47.

The above is an example of the printing treatment after the user has assigned the printing speed. In the following, the method for the thermal printer 10 to detect the ink-surface-outward winding or ink-surface-inward winding will be explained. For example, the detection treatment is executed by the main controller 29 when the thermal printer 10 is started or when an error takes place in the thermal head 24. The main controller 29 detects the winding direction according to the rotating direction of the feeding core 16 and rotation of the ink ribbon under consideration.

At first, for example, the ribbon diameter is determined, and, on the basis of the ribbon diameter, the feeding core 16 and the wind-up core 21 are rotated for the necessary quantity and are then stopped. The main controller 29 controls to ensure wrinkles do not form in the ink ribbon. Then, the main controller 29 generates torques in (a) the forward rotating direction and (b) the backward rotation direction in the rear-side feeding core 16, and, in each case, judgment is made on whether the feeding core 16 rotates.

(a) When the main controller 29 controls to have the feeding core 16 rotate when a torque in the forward rotating direction is applied on the feeding core 16, an estimate is carried out in the same way as in the example shown in FIG. 2. The main controller 29 judges that an ink-surface-outward winding ink ribbon 15 is set on the feeding core 16 and the ink-surface-outward winding ink ribbon 15 is released in a relaxed state, or it detects no ribbon is set on the feeding core 16. In addition, the ribbon end sensor 52 detects that no reflection signal is output from the ribbon, and the main controller 29 detects that the ink ribbon under consideration is an ink-surface-outward winding ink ribbon 15. On the other hand, when a torque in the forward rotating direction is applied on the feeding core 16 under control of the main controller 29, while the feeding core 16 does not rotate, just as in the example shown in FIG. 3, the main controller 29 detects that an ink-surface-inward winding ink ribbon 47 is set on the feeding core 16 and the ink-surface-inward winding ink ribbon 47 cannot be rotated.

(b) When the feeding core 16 rotates, as a torque in the backward rotation direction is applied under control of the main controller 29, the main controller 29 determines that either an ink-surface-inward winding ink ribbon 47 is set on the feeding core 16 (see FIG. 3) or no ribbon is set on the feeding core 16. As no reflection signal is detected by the ribbon end sensor 52, the main controller 29 detects the ink-surface-inward winding ink ribbon 47 is set on the feeding core 16. When the feeding core 16 does not rotate while a torque in the backward rotation direction is applied, the main controller 29 detects the ink ribbon is an ink-surface-outward winding ink ribbon 15 (see FIG. 2). In this way, from the rotating direction and a determination of yes/no of the rotating load, it is detected weather the winding direction of the ink ribbon is the ink-surface-outward winding or the ink-surface-inward winding.

While the main controller 29 detects the output of the ribbon end sensor 52, it also detects on/off by means of the slit sensor 31. This is because when there is no ribbon, the period of the pulse signal sequence has a higher speed than that of the period when the ink-surface-outward winding ink ribbon 15 or the ink-surface-inward winding ink ribbon 47 is set. Here, the "higher speed" refers to the state in which the result about the number of ON states and the number of OFF states due to sampling of the pulse waveform is lower than a preset threshold.

The above mention can be summarized as follows: the thermal printer 10 has DC motors for controlling the ribbon as a structural element on the wind-up side and feeding side (back tension side), respectively. The thermal printer 10 also has a thermal head 24 for performing a printing operation, a communication interface part 54 for communication with the external host PC, a display unit 26 made of an LCD for displaying the information, and a key input part 27 for key-in operation. The thermal printer 10 has an external memory module known as a hard disk drive for storing the printing data and registered data received from the external host PC.

In this way, the thermal printer 10 carries out detection of the ink-surface-outward winding or ink-surface-inward winding. In the prior art, depending on the specifications of the printer main body, the winding direction of the ribbon that can be actually adopted is limited to either the ink-surface-inward winding or the ink-surface-outward winding. Depending on the thermal printer and the method for detecting the ink ribbon winding direction related to the specific embodiment, the winding direction information is set for the printer main body, and the information can be changed manually, so that it is possible to change the direction of the feeding motor 17 on the back tension side corresponding to the ink-surface-inward winding or ink-surface-outward winding. The ink ribbon is a consumable (supply). By reversing the driving direction of the feeding motor 17, it is possible to get rid of the condition that only one wiring type of ink ribbon, such as the ink-surface-outward winding type, can be selected. With a printer constitution otherwise similar to the printer structure in the prior art, it is also possible to use an ink-surface-inward winding ink ribbon in addition to the ink-surface-outward winding type. As a result, the user is no longer inconvenienced in having to select the ink ribbon type corresponding to the printer model, as it is now possible to use one thermal printer 10 for both ribbons of the ink-surface-inward winding type and that of the ink-surface-outward winding type by simply reversing the direction of rotation of the ribbon motor.

In addition, after the ink ribbon being used is set on the shaft, the user can press the key input part 27, and the feeding motor 17 on the back tension side is rotated certain distance. As the feeding motor 17 is rotated, in either rotating direction, the ink ribbon is wound up and a tension is applied on the ink ribbon. As the tension is applied, the slit sensors 31, 32 are not rotated. According to the result regarding yes/no of rotation of the slit sensor 31, it is possible to judge whether the ink ribbon in the thermal printer 10 is ink-surface-inward winding or ink-surface-outward winding. Depending on the thermal printer and the method for detecting the winding direction of the ink ribbon, after setting the ink ribbon being used, the feeding motor 17 is rotated in a forward rotating direction or a backward rotating direction, the tension state of the ink ribbon for judgment is automatically detected, so that it is possible to judge whether the winding is the ink-surface-inward winding or the ink-surface-outward winding.

Other Adaptations

In the example, the user manually inputs the winding direction information. However, one may also adopt a scheme in which a software application is adopted as the setting tool so that the information is sent to the thermal printer 10. Connection between the personal computer and the thermal printer 10 is carried out by means of an interface cable. As the setting tool displays the icons for selection by the user on the screen of the personal computer, the user can selectively input the ink-surface-outward winding or ink-surface-inward winding, and the personal computer then sends the input information to the thermal printer 10. The information is read in when the thermal printer 10 is started after the thermal printer 10 stores the identification information in the RAM 28.

The feeding motor 17 directly drives the shaft 14, and wind-up motor 22 directly drives the shaft 21. However, one may also adopt a scheme in which the feeding motor 17 and wind-up motor 22 transmit the rotating force via a gear unit or other transmission mechanism of the driving force.

The present disclosure is not limited to the example embodiments as described, but rather encompasses variations and modifications which would be obvious to one skilled in the arts based on the disclosure contained herein. For example, in addition to the paper in the embodiment, printing may also be carried out on the surface of a paper-attached sticker or the like, with an adhesive coated on the back surface or plastic films. Also, the position of the thermal head can be changed.

In the treatment for detecting the winding direction, the following scheme may also be adopted: on the slit disk 40 shown in FIG. 4, another slit sensor is arranged, and, from the difference in the rising edge and falling edge of the output waveforms from the two slit holes 41 located at positions with different phases with respect to a circle, the rotating direction is detected.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A thermal printer comprising:

a feeding motor for rotating a feeding shaft and an ink ribbon disposed thereon in a forward or a backward rotational direction, the ink ribbon having a winding type consisting of either an outer ink surface winding type or an inner ink surface winding type;

a thermal print head utilized to thermally transfer a portion of ink from the ink ribbon to a medium as the ink ribbon is unwound from the feeding shaft;

a wind-up motor for rotating a wind-up shaft on which the unwound ink ribbon from the feeding shaft can be collected; and a controller for controlling the feeding motor based on the winding type of the ink ribbon.

2. The thermal printer of claim 1, further comprising:

an input part allowing a user to input the winding type of the ink ribbon, wherein the controller controls the feeding motor based on the winding type input by the user.

3. The thermal printer of claim 1, further comprising a storage part for storing table data, the table data containing a target rotating quantity and a driving current for controlling the feeding motor, wherein the controller is configured to extract table data from the storage part and the table data is utilized to control the feeding motor.

4. The thermal printer of claim 1, further comprising:

a detecting part configured to detect a rotational velocity of the feeding shaft.

5. The thermal printer of claim 4, wherein the winding type of the ink ribbon is determined using the detected rotational velocity of the feeding shaft.

6. The thermal printer of claim 4, wherein the detecting part comprises an encoder disposed on the feeding shaft, the encoder configured to generate a number of pulse signals corresponding to the rotational velocity, and the controller determines the rotational velocity based on the number of pulse signals generated by the encoder.

7. The thermal printer of claim 1, wherein the feeding motor transmits rotational force to the feeding shaft via a gear unit.

8. The thermal printer of claim 1, further comprising a ribbon end sensor for sensing an indicator strip in the ink ribbon.

9. A thermal printer, comprising:

a feeding motor for rotating a feeding shaft and an ink ribbon is disposed thereon in a forward or a backward rotational direction, the ink ribbon having a winding type consisting of either an outer ink surface winding type or an inner ink surface winding type;

a thermal print head utilized to thermally transfer an ink from the ink ribbon to a medium as the ink ribbon is unwound from the feeding shaft;

a wind-up motor for rotating a wind-up shaft on which the ink ribbon unwound from the feeding shaft can be collected;

a storage part for storing table data, the table data containing a target rotating quantity and a driving current for the feeding motor;

an input part for a user to input the winding type of the ink ribbon;

a detecting part for detecting a rotational velocity of the feeding shaft; and a controller for controlling the feeding motor based on the winding type of the ink ribbon as inputted by the user or as detected based on the rotational velocity of the feeding shaft wherein, the feeding motor is controlled to rotate the feeding shaft in a single direction during operation, the single direction being based on the winding type that is inputted or detected.

10. The thermal printer of claim 9, wherein the detecting part comprises:

a first slit disk with a plurality of slits arrayed along the circumferential direction of the disk, the first slit disk disposed so as to rotate with the feeding shaft; and a first slit sensor configured to determine whether a slit has passed the sensor, the sensor encoding the slit passage as pulse signals.

11. The thermal printer of claim 10, wherein the first slit sensor comprises:

a light-emitting diode disposed to one side of the slit disk; and a photo-diode disposed to the other side of the slit disk opposite the light-emitting diode, such that the light from the light-emitting diode is received by the photo-diode when one of the plurality of slits passes through the slit sensor.

12. The thermal printer of claim 9, further comprising:

a paper sensor for detecting a beginning of the medium to which ink is to be transferred; and a ink ribbon end sensor for detecting an indicator strip indicating the ink ribbon has been fully unwound from the feeding shaft.

13. The thermal printer of claim 9, wherein the medium is paper or a paper-backed label.

14. A method of detecting a winding type of an ink ribbon in a thermal printer including a feeding shaft and a wind-up shaft, the method comprising:

applying a first torque in a forward rotational direction to the wind-up shaft upon which the ink ribbon is also loaded;

applying a second torque in a first rotational direction to the feeding shaft upon which the ink ribbon is loaded;

detecting a rotational velocity of the feeding shaft while the second torque is applied to the feeding shaft;

determining the winding type based on the detected rotational velocity and the first rotational direction.

15. The method of claim 14, wherein the rotational velocity of the feeding shaft is detected using a slit sensor comprising a slit disk rotationally coupled to the feeding shaft.

16. The method of claim 14, wherein the winding type is determined to be an inner ink surface winding type when the first rotational direction is the forward rotational direction, and the detected rotational velocity is zero.

17. The method of claim 14, wherein the winding type is determined to be an outer ink surface winding type when the first rotational direction is the backward rotational direction and the detected rotational velocity is zero.

18. The method of claim 14, further comprising:

determining whether the ink ribbon loaded on the feeding shaft is present before determining the winding type.

19. The method of claim 18, wherein the winding type is determined to be an inner ink surface winding type when the first rotational direction is the backward rotational direction and the detected rotational velocity is greater than zero and the ink ribbon is determined to be present on the feeding shaft.

20. The method of claim 18, wherein the winding type is determined to be an outer ink surface winding type when the first rotational direction is the forward rotational direction and the detected rotational velocity is greater than zero and the ink ribbon is determined to be present on the feeding shaft.

* * * * *